US005314730A

United States Patent [19]

Flores

[11] Patent Number: 5,314,730

[45] Date of Patent: May 24, 1994

[54] ARTIFICIAL ORNAMENTAL FLOWER AND METHOD FOR MAKING AN ARTIFICIAL ORNAMENTAL FLOWER

[76] Inventor: Erlinda V. Flores, 1064 Billings Blvd., San Leandro, Calif. 94577

[21] Appl. No.: 921,940

[22] Filed: Jul. 30, 1992

[51] Int. Cl.[5] ..... A41G 1/00

[52] U.S. Cl. ..... 428/24; 156/61

[58] Field of Search ..... 428/24, 25, 26; 156/61

[56] References Cited

U.S. PATENT DOCUMENTS

| | | | |
|---|---|---|---|
| 1,694,844 | 12/1928 | Gerson et al. | 428/26 |
| 1,757,943 | 5/1930 | Mesa | 428/26 X |
| 1,766,351 | 6/1930 | Patterson | 428/26 |
| 1,831,560 | 11/1931 | Ham et al. | 428/26 |
| 1,911,983 | 5/1933 | Addis et al. | 428/26 X |
| 2,054,605 | 9/1936 | Rogers | 428/26 |
| 3,146,153 | 8/1964 | Stein | 428/26 |
| 4,333,778 | 6/1982 | Griffin | 428/24 X |
| 4,525,394 | 6/1985 | Standley | 428/26 |
| 4,738,881 | 4/1988 | Lee | 428/24 X |
| 5,145,730 | 9/1992 | Cheng | 428/24 |

*Primary Examiner*—Henry F. Epstein
*Attorney, Agent, or Firm*—Burns, Doane, Swecker & Mathis

[57] ABSTRACT

An artificial flower includes a ribbon folded to form a descending spiral such that a folded edge of the ribbon faces the outer edge of the ribbon. The descending spiral formed from the ribbon engages with a stem and is wound about the stem such that the folded edge is approximately even with the upper end of the stem. The folded edge simulates flower petals. A method for making an artificial flower is also described.

18 Claims, 7 Drawing Sheets

ARTIFICIAL ORNAMENTAL FLOWER AND METHOD FOR MAKING AN ARTIFICIAL ORNAMENTAL FLOWER

BACKGROUND

This invention relates to an artificial ornamental flower and a method of making an artificial ornamental flower and, more particularly, relates to an artificial flower of the type formed by folding a ribbon to simulate flower petals.

It is possible to form artificial flowers simulating a wide variety of flower types, usually by wrapping colored ribbons around simulated stems in substantially the shape of the actual flower. Artificial flowers make attractive gifts and can be provided with scents to even more closely simulate the actual flower. Artificial flowers are also useful in situations where real flowers are, for whatever reason, unavailable, or for persons with allergies to real flowers.

It is popular to decorate artificial flowers with a variety of ornaments. During holiday seasons, artificial flowers are often decorated with miniature symbols of the holiday, such as Leprechauns during St. Patrick's Day, Santa Clauses during Christmas, and so on. Further, because the flowers are constructed from colored ribbon, the flowers can be constructed with ribbon colored in colors that bring to mind the particular holiday.

When it is desired to decorate certain artificial flower types, however, the flexibility of the flower makes it difficult to position ornaments on the flower without causing the flower to sag. Further, most methods for constructing artificial flowers simply involve twisting a piece of ribbon around a wire. Such methods do not generally securely engage the ribbon and the wire and do not create a sufficiently realistic effect. Further, it is not generally possible to alter an assembly process to create artificial flowers that simulate flowers in different stages of bloom, or is it generally possible to manipulate an already assembled flower such that is is able to simulate flowers in different stages of bloom.

SUMMARY OF THE PREFERRED EMBODIMENT

In accordance with one aspect of the present invention, an artificial flower comprises stem means for supporting an artificial flower portion, the stem means including a ribbon engaging means at an upper end thereof for engaging the artificial flower portion, the ribbon engaging means defining a top end of the stem means. A ribbon is provided for forming the artificial flower portion, the ribbon engaging means of the stem means extending through the ribbon to engage the stem means and the ribbon. The ribbon is repeatedly diagonally folded to form a plurality of diagonal folds at a plurality of positions along a longitudinal length of the ribbon, the diagonal folds being folded at predetermined angles and forming a descending spiral. At least a portion of diagonal fold faces an outer folded edge of the spiral. The descending spiral is wound around the stem means such that the outer folded edge of the spiral is positioned at a predetermined height relative to the top end of the stem means to form the flower. Binding means are provided for binding at least a portion of an inner edge of the spiral and an end of the wound, folded ribbon to a lower portion of the stem means. The folded, wound, and bound ribbon is adapted to simulate flowers in desired stages of bloom by turning the stem means relative to the binding means.

In accordance with another embodiment of the present invention, a method for making an artificial flower comprises the steps of providing a wire having a ribbon engaging means on a portion of a first end thereof, defining a top end of the wire. The ribbon engaging means of the wire is engaged with a ribbon by inserting the ribbon engaging means through a predetermined position near a first end of the ribbon. The ribbon is folded diagonally to form a plurality of diagonal folds at a plurality of positions along a longitudinal length of the ribbon, the diagonal folds being folded at predetermined angles for the flower to be formed and forming a descending spiral. At least a portion of each diagonal fold faces an outer folded edge of the descending spiral. The descending spiral is wound around the wire such that the outer folded edge of the descending spiral is positioned at a predetermined height relative to the top end of the wire. An inner edge of the spiral is bound around a lower portion of the wire.

In accordance with yet another aspect of the invention, in a method for making an artificial flower, the steps of folding the ribbon diagonally to form a descending spiral and winding the descending spiral around the wire are performed simultaneously.

BRIEF DESCRIPTION OF THE DRAWINGS

The features and advantages of the present invention will be well understood by reading the following detailed description in conjunction with the drawings in which like numerals indicate similar elements and in which.

DETAILED DESCRIPTION

Figure 1:
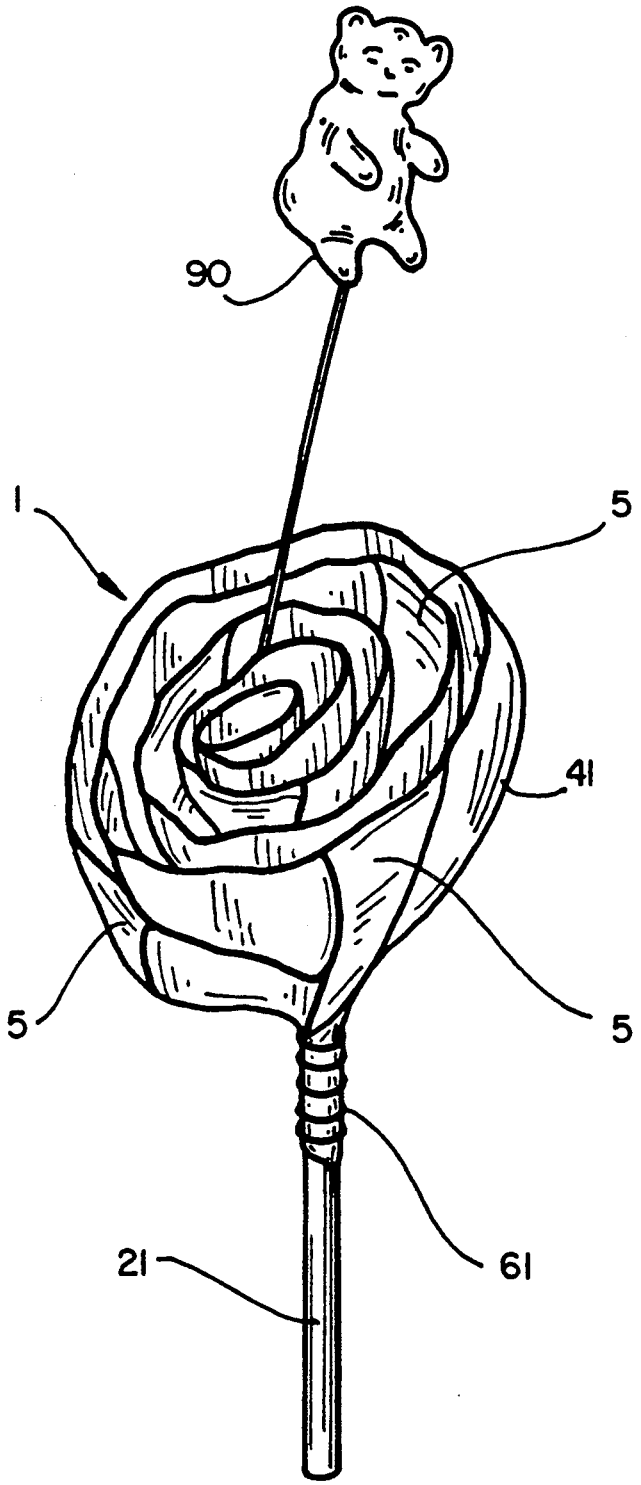
FIG. 1 is a perspective view of a finished flower according to an embodiment of the present invention.

With reference to FIG. 1, an embodiment of a flower 1 includes artificial stem means 21, a ribbon 41 wrapped around the stem to form a flower, and binding means 61 for binding the wrapped ribbon around the stem. The flower 1 may be decorated with an ornament 90 secured to one of a plurality of simulated petals 5.

Figure 2:
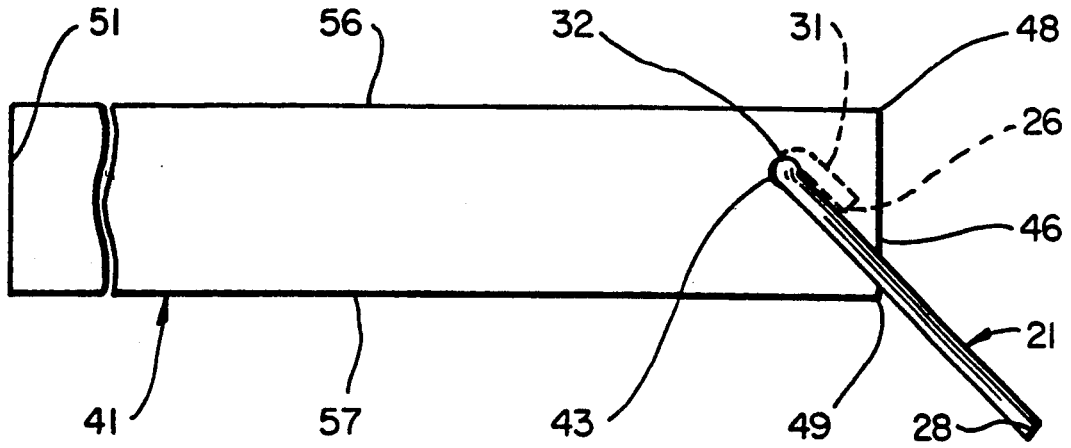
FIG. 2 is a schematic representation of a ribbon fragment and hook at an initial step in the assembly of a flower according to an embodiment of the present invention.

FIG. 2 shows stem means 21 for supporting an artificial flower and an unfolded ribbon 41 for forming an artificial flower. The stem means 21 includes a ribbon engaging means or hook 31 at a first end 26 of the stem means, the hook defining a top end 32 of the stem means. The stem means 21 may be a piece of bent wire, usually a #16 gauge wire, approximately 12 inches long, and is preferably green or brown to simulate the color of an actual flower stem. Instead of forming the hook 31 merely at a first end 26 of the stem means 21, the stem means may be bent substantially in half (not shown).

The ribbon 41 may be of a desired length and width. It is possible to simulate realistic roses with a ribbon approximately two feet long by approximately 2¾" wide. Ordinarily, a satin ribbon is used, however, desired effects may be achieved with other types of fabric. The hook 31 is inserted through a hole 43 in the ribbon 41 approximately one third of the width of the ribbon from a top edge 56 and near a first end 46 of the ribbon. The hole may be preformed or may be formed by poking the first end 26 or the second end 28 of the stem means 21 through the ribbon 41. The ribbon 41 also has a bottom edge 57 and a second end 51. The hook 31 is passed through the hole 43 and the stem means 21 is disposed at a desired angle relative to the length of the ribbon 41 toward a bottom corner 49 of the ribbon 41.

Figure 3:
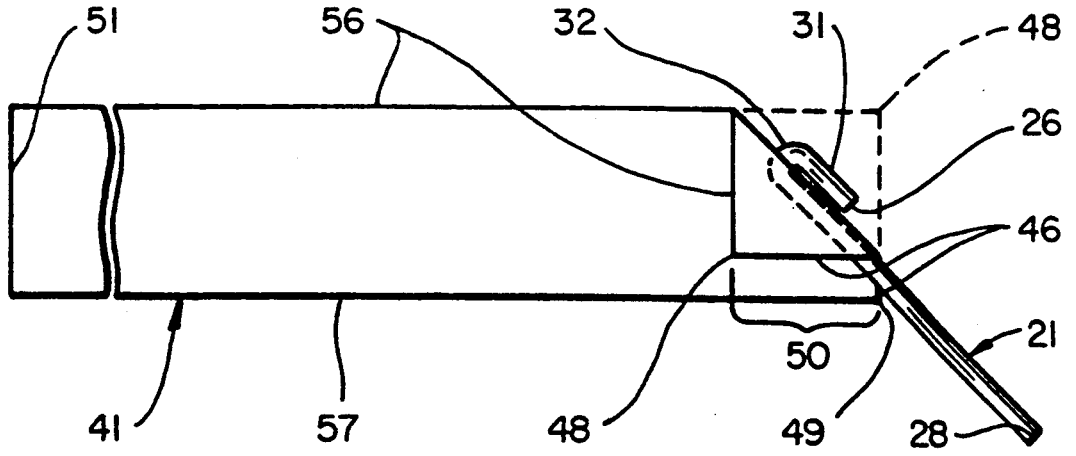
FIG. 3 is a schematic representation of a hook and ribbon fragment folded in a step in the assembly of a flower subsequent to the view shown in FIG. 2.
Figure 4A:
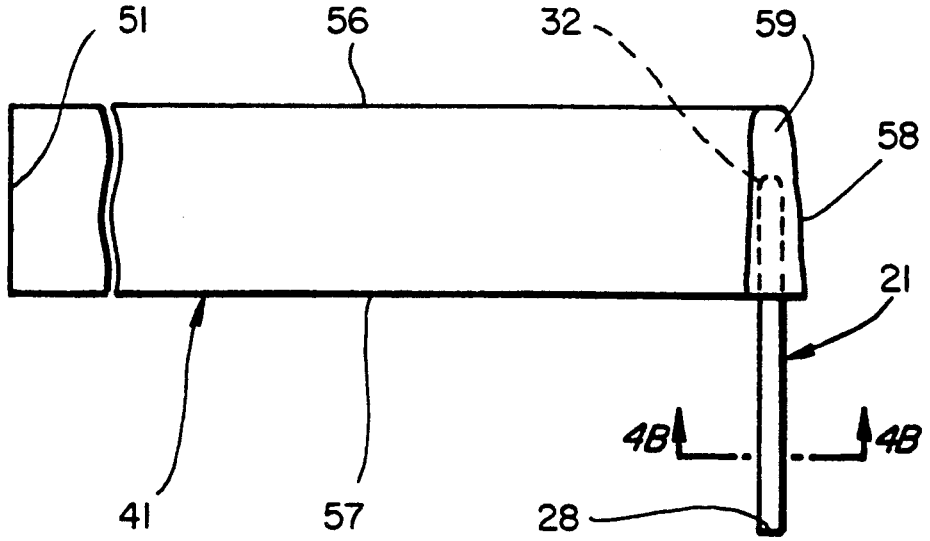
FIG. 4A is a schematic representation of a hook and ribbon fragment folded and wound in a step in the assembly of a flower subsequent to the view shown in FIG. 3.
Figure 4B:
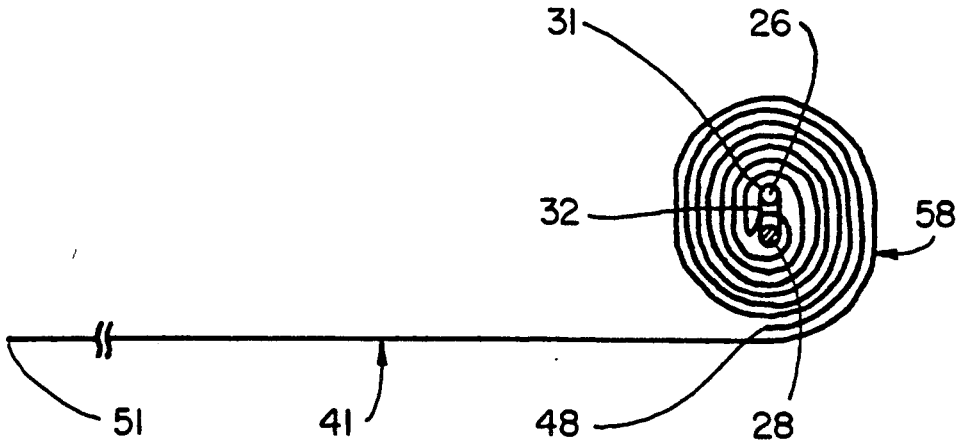
FIG. 4B is a schematic representation of the hook and ribbon fragment taken at section 4B—4B of FIG. 4A.

With reference to FIG. 3, a top corner 48 of the ribbon 41 is diagonally folded out of the picture (towards the reader) over the stem means 21 and forms a folded portion 50. As seen in FIGS. 4A and 4B, the folded portion 50 is wound around the stem means 21 so that the top corner 48 is wound up inside of a wound spiral that forms a conical shape 58 so that the stem means 21 is substantially perpendicular to the top and bottom edges 56 and 57 of the ribbon 41. Preferably the folded portion 58 is wound around the stem means 21 about three times. A portion 59 of the conical shape 58 extends past the stem means 21.

Figure 5:
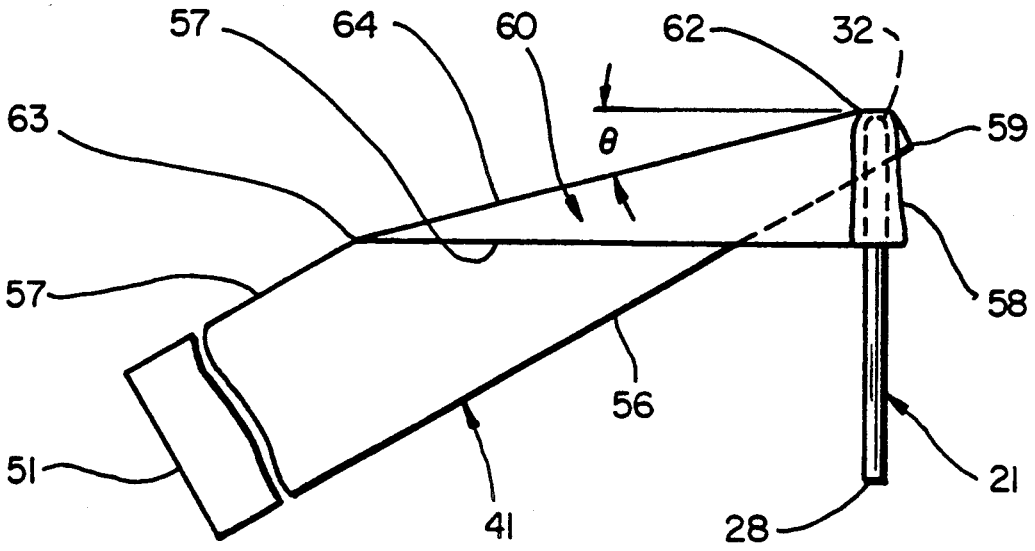
FIG. 5 is a schematic representation of a hook and ribbon fragment folded in a step in the assembly of a flower subsequent to the views shown in FIGS. 4A and 4B.

As seen in FIG. 5, a portion of the ribbon 41 and the portion 59 of the conical shape 58 are folded diagonally into the picture (away from the reader). The direction into the picture shall be referred to as a downward or descending direction. The fold is at a diagonal angle Θ, less than about 50°, and forms a first folded section 60, a first rear corner 62, a first leading corner 63, and a first diagonal folded edge 64. The ribbon 41 and the stem means 21 are securely engaged to one another by folding and winding the ribbon and the stem means in the manner thus described and shown in FIGS. 2-5.

Figure 6:
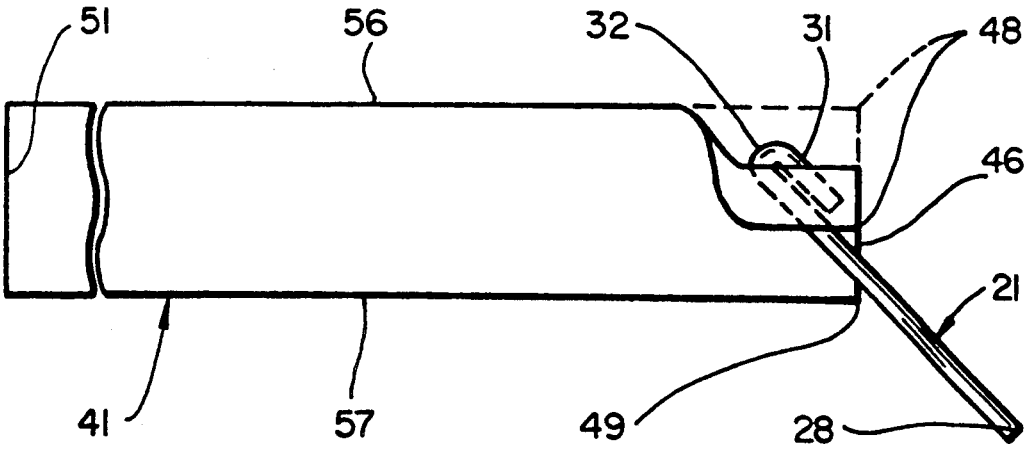
FIG. 6 is a schematic representation of a hook and ribbon fragment folded in a step in the assembly of a flower subsequent to the view shown in FIG. 2.
Figure 7:
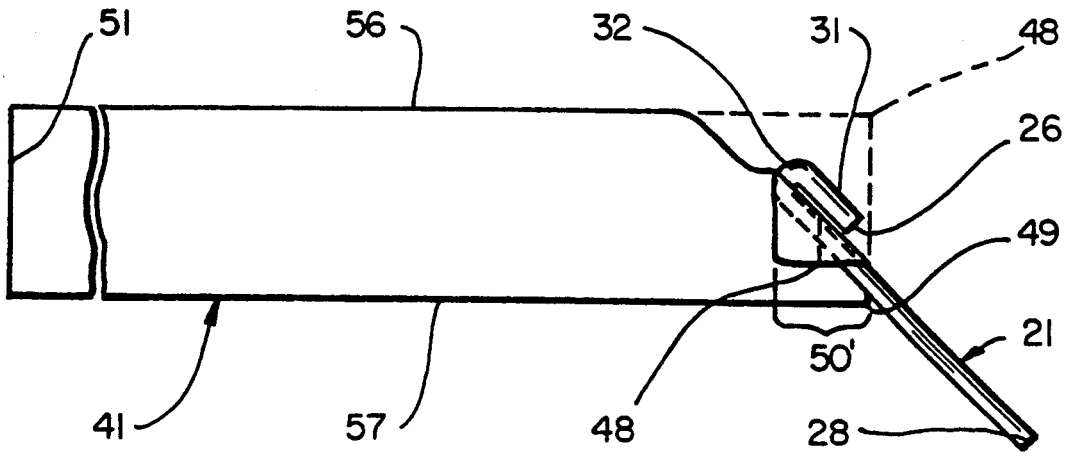
FIG. 7 is a schematic representation of a hook and ribbon fragment folded in a step in the assembly of a flower subsequent to the view shown in FIG. 6.
Figure 8:
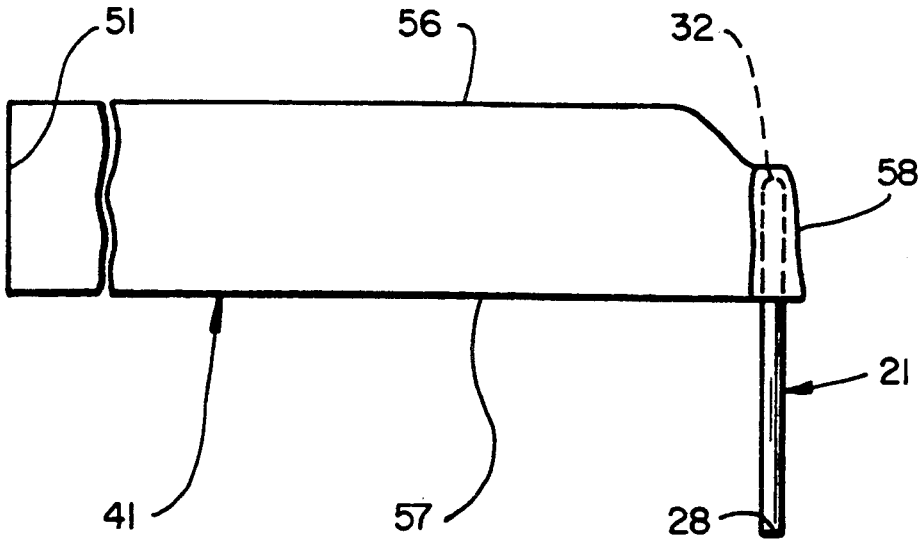
FIG. 8 is a schematic representation of a hook and folded ribbon fragment folded and wound in a step in the assembly of a flower according to an embodiment of the present invention subsequent to the view of FIG. 7.

As shown in FIGS. 6, 7, and 8, the ribbon 41 and the stem means 21 may, alternatively, be securely engaged to one another by first folding a portion of the top edge 56 of the ribbon over the stem means, then forming a folded portion 50', and then winding the folded portion 50' around the stem means to form a conical shape 58'. In this fashion, no portion 59 of the conical shape 58' is formed. The ribbon 41 is then folded diagonally, as in FIG. 5, at a diagonal angle Θ less than about 50°, and forms a first folded section 60, a first rear corner 62, a first leading corner 63, and a first diagonal folded edge 64.

Figure 9:
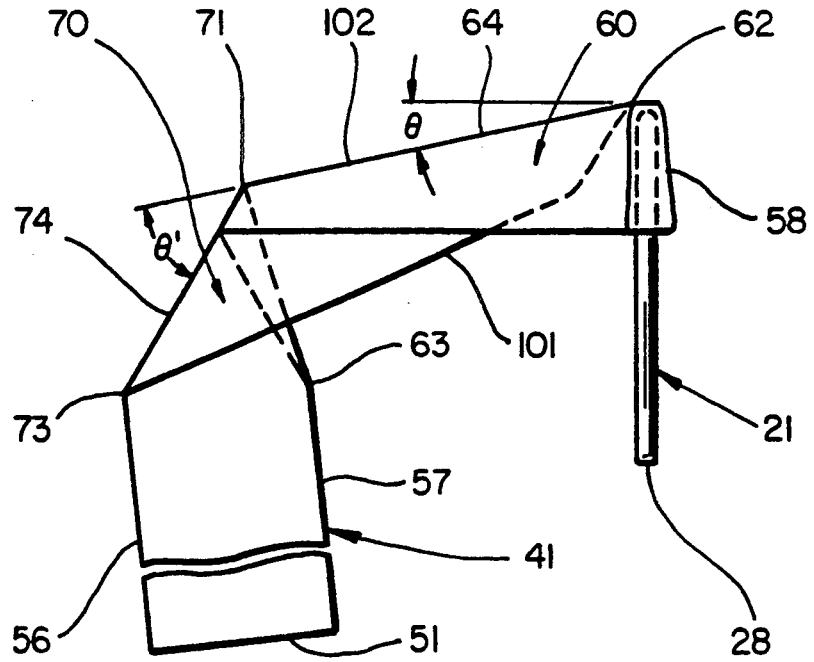
FIG. 9 is a schematic representation of a hook and ribbon fragment folded in a step in the assembly of a flower subsequent to the view shown in FIG. 5.
Figure 10:
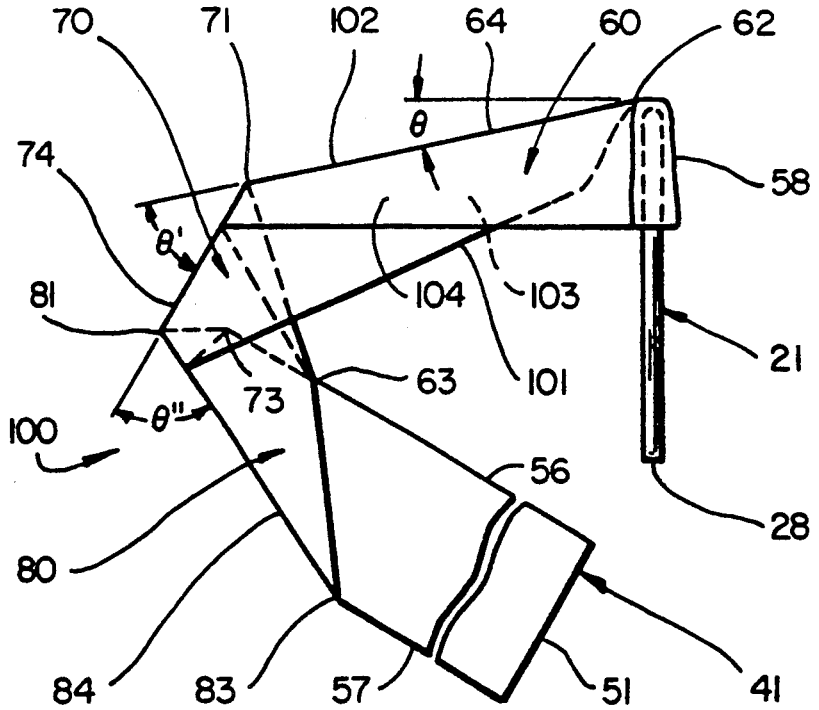
FIG. 10 is a schematic representation of a hook and ribbon fragment folded in a step in the assembly of a flower subsequent to the view shown in FIG. 9.

A plurality of folded sections are formed in the ribbon by folding the ribbon diagonally and downwardly (away from the reader) at desired angles, each less than about 50°, and at a plurality of positions along the length of the ribbon. FIGS. 9 and 10, respectively, show two folded sections 70 and 80 formed after the first folded section 60. As seen in FIG. 10, the ribbon 41, having a plurality of folded sections formed along its length, acquires the shape of what shall be referred to as a descending spiral 100 having an inner edge 101 and an outer edge 102 and a downward or descending surface 103 and an upper or ascending surface 104.

FIG. 9 shows the ribbon 41 folded downwardly to form a second folded section 70. The ribbon 41 is folded diagonally at a second angle Θ', which may be equal to the predetermined angle Θ and is less than about 50°, to form the second folded section 70 having a second rear corner 71, a second leading corner 73, and a second diagonal folded edge 74. The second rear corner 71 of the second folded section 70 is preferably at some location along the first diagonal folded edge 64 of the first folded section 60, such that a folded edge portion of the first folded section is on an outer edge 102 of the descending spiral 100 and the first leading corner 63 of the first diagonal folded section is located inwardly of the outer side of the descending spiral.

FIG. 10 shows the ribbon 41 folded diagonally yet another time to form a third folded section 80. The ribbon is folded at a third diagonal angle Θ'', which may be equal to the predetermined angle Θ and is less than about 50°, to form the third folded section 80 having a third rear corner 81, a third leading corner 83, and a third folded edge 84. The third rear corner 81 of the third folded section 80 is preferably at some location along the second folded edge 74 of the second folded section 70, such that a folded edge portion of the second folded section is on an outer edge 102 of the descending spiral 100 and the second leading corner 73 of the second folded section is located inwardly of the outer side of the descending spiral.

Diagonal folds, such as those shown in FIGS. 9 and 10 and described above, are formed in the ribbon 41 at a plurality of positions along the longitudinal length of the ribbon until the second end 51 of the ribbon 41 is reached, and it is no longer possible to fold the ribbon material. Preferably the folds are located at a distance to allow the ribbon to be wound about one to three times around the stem means 21 before another fold. By folding succeeding rear corners of succeeding folded sections at some location along the folded edge of a preceding folded section, such that a folded edge portion of the preceding folded section is on an outer side of the ribbon material, it is possible to form the descending spiral 100 so that the outer edge 102 of the descending spiral comprises a series of folded edges. The various folded edges and raw edges of material that are visible on the wound descending spiral have the appearance of a plurality of petals 5.

Figure 11:
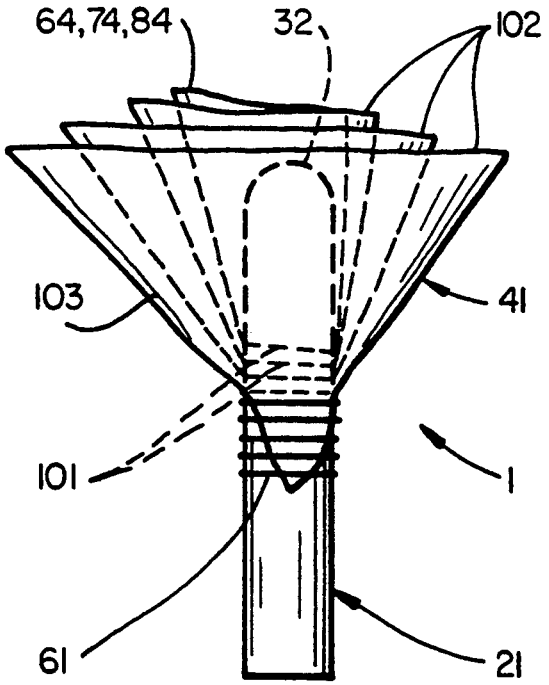
FIG. 11 is a schematic representation of a hook and folded ribbon fragment in a winding step in the assembly of a flower according to an embodiment of the present invention.

As seen in FIG. 11, the folded ribbon 41 is wound around the stem means 21 so that the folded downward or descending surface 103 of the descending spiral faces outwardly away from the stem means, and the outer edge 102 of the descending spiral 100 forms the top of the flower 1 and is substantially even with the top end 32 of the stem means 21. The inner edge 101 of the descending spiral 100 forms the bottom of the flower 1. The inner edge 101 of the descending spiral 100 is of a shorter peripheral length than the outer edge 102 of the descending spiral and, as the descending spiral is wound around the stem means 21, the greater peripheral length of the outer side of the descending spiral causes the wound descending spiral to form a cone shape that is suggestive of the shape of a real flower. When the descending spiral 100 is completely wound about the stem means 21, the excess material of the ribbon is gathered around the bottom of the flower 1, defined by the inner edge 101 of the descending spiral 100, and the stem means 21 and is bound with binding means 61 such as wire, as shown in FIG. 1. If desired, the binding means 61 and excess ribbon material may be concealed from view with a substance such as a green or brown tape (not shown) and other ornamentation.

After the descending spiral 100 is wound around the stem means 21 and bound with binding means 61, it is possible to simulate flowers in various stages of bloom by turning the stem means relative to the binding means. The binding means 61 maintains the dimensions of the bottom of the flower 1, however, the top of the flower opens further or closes tighter depending upon the direction in which the stem means 21 is turned. If the flower becomes deformed, it is possible to readjust the flowers' shape by turning the stem means relative to the binding means.

As described above, the descending spiral 100 is generally formed by folding succeeding rear corners of succeeding folded sections at some point along a preceding folded edge of a preceding folded section. It is also possible to form a descending spiral 100 for forming a flower without folding succeeding rear corners of succeeding folded sections at some location along the folded edge of a preceding folded section and, instead, fold succeeding rear corners of succeeding folded sections at a location (not shown) further toward the end 51 of the ribbon on the top edge 56 or the bottom edge 57 of the ribbon. The flower that is formed from folding the ribbon in that fashion, however, has unfolded fabric edges exposed on top of the petal and may not achieve the desired realism.

Figure 12:
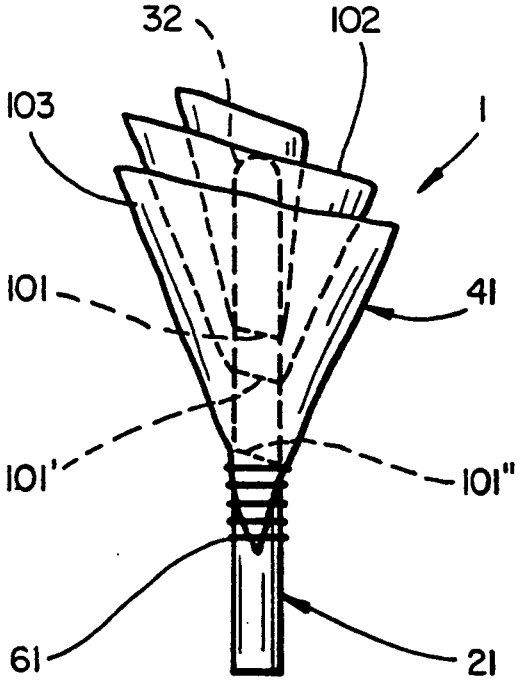
FIG. 12 is a schematic representation of a hook and folded ribbon fragment in a winding step in the assembly of a flower according to an embodiment of the present invention.

As described above, it is possible to simulate flowers in various stages of bloom by turning the stem means 21 relative to the binding means 61. It is also possible to adjust the tension of the winding of the descending spiral 100 around the stem means 21 during the winding process and thereby simulate flowers in various stages of bloom. For example, by winding the descending spiral 100 tightly around the stem means 21, the flower appears less fully bloomed. In addition to varying the winding tension of the descending spiral 100 around the stem means 21 to simulate various stages of bloom, it is possible to vary the position of successive turns of the inner edge 102 of the descending spiral around the stem to simulate various stages of bloom. As shown in FIG. 12, by making successive turns of the inner edge 101, 101', 101" of the descending spiral 100 progressively further down the stem means 21 toward the second end 28 of the stem means, the flower 1 appears thinner and more bud-like. If a more fully bloomed flower is desired, the winding tension is decreased and successive turns of the ribbon 41 are made at substantially the same position on the stem means 21.

Ornaments 100 may be attached to various positions on the flower 1. One advantage of this method for making artificial ornamental flowers is that if the ornaments 100 are particularly heavy and would cause the flower petals 5 to sag if the ornament was attached to the petals, the ornament may be positioned in the center of the flower over the hook such that the hook will bear the weight of the ornament.

As one illustration of an embodiment of this invention, a 12 inch, #16 gauge wire (49 lbs.) from Highland Wire Inc., High.and, Ill. was used and a hook was formed by bending the wire about 1" from one end. Approximately 2 feet of McGinley satin #40 ribbon (Chester, N.J.) approximately 2 ¾" wide was used to form the flower. The hook was inserted through a hole in the ribbon approximately one third of the width of the ribbon from the top edge and approximately 1½ from the first end of the ribbon. The wire is disposed toward the bottom corner of the first end of the ribbon. The top corner of the first end of the ribbon is folded over the wire. The ribbon is wound around the wire three times, so that the top corner is wound up inside the wound ribbon. The top edge of the ribbon is folded down and away from the reader such that the outer edge of the spiral is substantially even with the top of the hook. The fold creates a diagonal fold of the ribbon at an angle of approximately 10°. The ribbon is wound three times and then the ribbon is folded down and away from the reader and downwards to form an angle of approximately 50°. The ribbon is wound two times and then folded down and away from the reader at an angle of approximately 50°. The ribbon is again wound two times and then folded down and away from the reader at the same angle. The ribbon is then wound around the wire once and folded at the same angle downwards. This is repeated until the second end of the ribbon is reached. The inner edge of the spiral and the second end of the ribbon are secured t the wire by winding #28 gauge green florist wire around the inner edge tightly. Green floral tape, generally a plastic material, from American National Can/Floral Products (Greenwich, Conn.) can be wrapped around the florist wire to hide the wire. An ornament on a wire may be attached to the top center of the flower by applying hot glue (Lee Imports Inc., Hayward, Calif.) and Aleene's Original Tachy Glue (Aleene's Division Artis Inc., Buellton, Calif.) to the ornament wire and inserting the wire into the middle of the flower close to the hook such that the ornament is positioned at the top center of the flower.

It is, of course, possible to embody the invention in specific forms other than those described above without departing from the spirit of the present invention. The embodiments described above are merely illustrative and should not be considered restrictive in any way. The scope of the invention is given in the appended claims, rather than the preceding description, and all variations and equivalents which fall within the range of the claims are intended to be embraced therein.

What is claimed is:

1. An artificial flower, comprising:

stem means for supporting an artificial flower portion, the stem means including a ribbon engaging means at an upper end thereof for engaging the artificial flower portion, the ribbon engaging means defining a top end of the stem means;

a ribbon for forming the artificial flower portion, the ribbon engaging means of the stem means extending through the ribbon to engage the stem means and the ribbon, the ribbon being repeatedly diagonally folded to form a plurality of diagonal folds at a plurality of positions along a longitudinal length of the ribbon, the diagonal folds being folded at predetermined angles and forming a descending spiral, at least a portion of each diagonal fold facing an outer edge of the descending spiral, the descending spiral being wound around the stem means such that the outer edge of the descending spiral is positioned at a predetermined height relative to the top end of the stem means to form the desired flower; and binding means for binding at least a portion of an inner edge of the descending spiral and an end of the wound, folded ribbon to a portion of the stem means, wherein the folded, wound, and bound ribbon is adapted to simulate flowers in desired stages of bloom by turning the stem means relative to the binding means.

2. The artificial flower as set forth in claim 1, wherein the folded, wound ribbon is adapted to simulate flowers in desired stages of bloom by being wound around the stem means in a tighter or a looser fashion.

3. The artificial flower as set forth in claim 1, wherein flowers in desired stages of bloom are further adapted to be simulated by winding successive turns of the folded ribbon at greater or lesser distances from preceding turns.

4. The artificial flower as set forth in claim 1, wherein the flower is adapted to support decorations secured to the petals of the flower.

5. The artificial flower as set forth in claim 1, wherein the ribbon engaging means is a hook portion of the stem means.

6. The artificial flower as set forth in claim 1, wherein the fold angles are substantially equal.

7. The artificial flower as set forth in claim 1, wherein the outer edge of the descending spiral is substantially at the same height as the top end of the stem means.

8. A method for making an artificial flower, comprising the steps of:

providing a stem means having a ribbon engaging means on a portion of a first end thereof, the ribbon engaging means defining a top end of the stem means;

engaging the ribbon engaging means of the stem means with a ribbon by inserting the ribbon engaging means through a predetermined position near a first end of the ribbon;

folding the ribbon diagonally to form a plurality of diagonal folds at a plurality of positions along a longitudinal length of the ribbon, the diagonal folds being folded at predetermined angles for the flower to be formed and forming a descending spiral, at least a portion of each diagonal fold facing an outer edge of the descending spiral;

winding the descending spiral around the stem means such that the outer edge of the descending spiral is positioned at a predetermined height relative to the top end of the stem means;

binding a portion of the ribbon with binding means, near a second end of the ribbon, around a portion of the stem means; and simulating a flower in a desired state of bloom by turning the stem means relative to the binding means.

9. The method for making an artificial flower of claim 8, wherein the steps of folding the ribbon diagonally to form a descending spiral and winding the descending spiral around the stem means are performed simultaneously.

10. The method for making an artificial flower of claim 8, comprising the further step of simulating a flower in a desired state of bloom by varying the tension with which the descending spiral is wound around the stem means.

11. The method for making an artificial flower of claim 8, comprising the further step of simulating a flower in a desired stage of bloom by winding successive turns of an inner edge of the descending spiral at varying distances on the stem means from preceding turns.

12. The method for making an artificial flower of claim 8, comprising the further step of covering the bound portion of the ribbon with a colored plastic material.

13. The method for making an artificial flower of claim 8, comprising the further step of decorating the flower with desired ornaments.

14. The method for making an artificial flower of claim 8, further comprising the step of forming a desired number of simulated petals by varying the angle at which the ribbon is folded diagonally.

15. The method for making an artificial flower of claim 8, further comprising the step of forming a desired number of simulated petals by varying the longitudinal distance between diagonal folds of the ribbon.

16. The method for making an artificial flower of claim 8, wherein the ribbon engaging means is a hook portion of the stem means.

17. The method for making an artificial flower of claim 8, wherein the fold angles are substantially equal.

18. The method for making an artificial flower of claim 8, wherein the outer edge of the descending spiral is substantially at the same height as the top end of the stem means.

* * * * *